US009845177B1

(12) United States Patent
Goodson

(10) Patent No.: US 9,845,177 B1
(45) Date of Patent: Dec. 19, 2017

(54) DRINKING CUP

(71) Applicant: Mark Goodson, Corinth, TX (US)

(72) Inventor: Mark Goodson, Corinth, TX (US)

( * ) Notice: Subject to any disclaimer, the term of this patent is extended or adjusted under 35 U.S.C. 154(b) by 0 days.

(21) Appl. No.: 15/591,269

(22) Filed: May 10, 2017

Related U.S. Application Data

(60) Provisional application No. 62/375,575, filed on Aug. 16, 2016.

(51) Int. Cl.

| | |
|---|---|
| ***A47G 19/22*** | (2006.01) |
| ***B65D 25/28*** | (2006.01) |
| ***B65D 3/06*** | (2006.01) |
| ***B65D 3/30*** | (2006.01) |
| ***B65D 21/02*** | (2006.01) |
| ***B65D 1/26*** | (2006.01) |
| ***B65D 1/40*** | (2006.01) |

(52) U.S. Cl.
CPC ..... *B65D 25/2897* (2013.01); *A47G 19/2205* (2013.01); *B65D 1/265* (2013.01); *B65D 1/40* (2013.01); *B65D 3/06* (2013.01); *B65D 3/30* (2013.01); *B65D 21/0233* (2013.01)

(58) Field of Classification Search
CPC ..... B65D 25/2897; B65D 3/06; B65D 3/30; B65D 21/0233; B65D 1/22; B65D 1/26; B65D 1/265; B65D 1/40; A47G 19/2205
USPC ..... 215/DIG. 7; 222/572, 158; 206/519, 515
See application file for complete search history.

(56) References Cited

U.S. PATENT DOCUMENTS

| | | | | | |
|---|---|---|---|---|---|
| D31,230 | S | * | 7/1899 | Hogan | D7/509 |
| D34,708 | S | * | 7/1901 | Evans | D24/110 |
| 1,238,092 | A | * | 8/1917 | Blass | B65D 21/0231 206/519 |
| 1,421,696 | A | * | 7/1922 | Kucera | A47G 19/2205 206/217 |
| 1,651,485 | A | * | 12/1927 | Thesen | A47G 19/2205 222/158 |
| 2,054,934 | A | * | 9/1936 | Graffenberger | B65D 1/26 211/14 |
| 2,493,633 | A | * | 1/1950 | Mart | B65D 1/265 206/519 |
| 2,530,124 | A | * | 11/1950 | Kieckhefer | B65D 1/265 206/515 |
| D167,166 | S | * | 7/1952 | Rodier | D7/318 |
| 3,260,781 | A | | 7/1966 | Lux et al. | |
| D214,749 | S | * | 7/1969 | Ferrara | D7/584 |
| 3,622,036 | A | * | 11/1971 | Bongaerts | A01K 5/0114 119/61.5 |
| 3,897,899 | A | | 8/1975 | Schuff et al. | |
| D259,011 | S | * | 4/1981 | Daenen | D7/316 |
| D264,795 | S | * | 6/1982 | Strieber | D7/318 |
| D268,978 | S | * | 5/1983 | Strieber | D7/319 |
| 4,610,351 | A | * | 9/1986 | Coles | B65D 1/265 206/217 |

(Continued)

*Primary Examiner* — J. Gregory Pickett
*Assistant Examiner* — Gideon Weinerth
(74) *Attorney, Agent, or Firm* — Gunn, Lee & Cave, PC

(57) ABSTRACT

A sanitary disposable drinking cup is described. The cup is designed to be grabbed from the top when served, but has a portion of its top circumference that is recessed vertically, so as to create both separate gripping and drinking surfaces so as to allow for serving personnel to handle the cup from the top surface without the necessity of contaminating the drinking surface. The cup is designed to nest so as to accommodate multiple cups being easily stored.

9 Claims, 3 Drawing Sheets

(56) References Cited

U.S. PATENT DOCUMENTS

| | | | | | |
|---|---|---|---|---|---|
| 4,726,487 | A * | 2/1988 | Mitri | B65D 1/265 | 220/718 |
| 4,867,313 | A * | 9/1989 | Padovani | B65D 1/265 | 206/515 |
| 5,246,149 | A * | 9/1993 | Broitzman | A47G 19/12 | 222/465.1 |
| D342,642 | S * | 12/1993 | Brazis | D7/316 | |
| 5,388,732 | A * | 2/1995 | Greger | A47J 36/08 | 210/467 |
| 5,415,339 | A | 5/1995 | Howard | | |
| D371,939 | S * | 7/1996 | Rigney | D7/509 | |
| D373,932 | S * | 9/1996 | Onneweer | D7/315 | |
| 5,626,256 | A * | 5/1997 | Onneweer | A47J 43/0727 | 220/574 |
| 6,409,374 | B1 * | 6/2002 | Willat | A47G 19/2205 | 206/520 |
| 6,551,672 | B2 * | 4/2003 | Hessok | A61J 1/00 | 206/168 |
| 6,561,375 | B1 * | 5/2003 | Nagy | A47G 19/02 | 206/460 |
| D623,359 | S * | 9/2010 | Kim | D30/129 | |
| 8,701,914 | B1 | 4/2014 | Buck | | |
| 9,655,460 | B1 * | 5/2017 | McClinton | A47G 19/02 | |
| 2005/0092759 | A1 * | 5/2005 | Willat | A47G 19/2205 | 220/703 |
| 2008/0083766 | A1 * | 4/2008 | De Rosa | A47G 19/2205 | 220/703 |
| 2011/0297688 | A1 * | 12/2011 | Bangert | A47G 19/2205 | 220/710.5 |

* cited by examiner

DRINKING CUP

CROSS-REFERENCES TO RELATED APPLICATIONS

This application claims the benefit of U.S. Provisional Application Ser. No. 62/375,575 filed Aug. 16, 2016. The contents of that application are incorporated by reference herein.

STATEMENT REGARDING FEDERALLY SPONSORED RESEARCH OR DEVELOPMENT

Not applicable.

BACKGROUND OF THE INVENTION

1. Field of the Invention

The present invention generally applies to a drinking cup.

2. Background of the Related Art

The service industry typically relies on disposable or souvenir cups to serve to drinks. These cups generally have varied heights, diameters, and volume but all have a singular continuous rim encircling the top of the cup. This top edge provides a uniform surface in which the user may drink from any portion of the cup.

In certain settings, such as in an airplane or concession stand, the disposable or souvenir cup must be handled by a person other than the ultimate user. In these settings, space is often at a premium and there is a tendency to provide rushed service with little attention to sanitary handling of the cups. In particular, it is common for flight attendants and concession stand personnel to handle beverage cups by the rim, which is the same surface the ultimate user drinks from. In the airline setting, the desired cup is usually disposable, short, and wide. The characteristics of the cup are designed to remain upright in turbulent settings. Due to the size of the cup, the narrow confines of a plane, and the change in elevation of cup delivery (i.e. the flight attendant is standing and delivering the cup to a seated passenger), flight attendants typically hold the cup in a technique referred to as "The Claw." The flight attendant grabs the cup by the top rim, with thumb at zero degrees and the three great fingers located at about 140, 180, and 220 degrees when referenced to the thumb. This grip is very stable, but it also places the fingers on the top rim of the cup. This results in an unsanitary practice as user's may drink from the cop in a place in which the flight attendant had previously placed their fingers. Considering airplanes are known to be germ laden, as it is difficult for a flight attendant to keep their hands clean while handling the numerous surfaces involved in their job, this practice results in an unsanitary environment. Similarly, concession stand workers and others in the service industry also often handle the cup by the top edge as it is sometimes easier and faster to serve ultimate users. Similarly, a user when carrying the cup back to their seat may often use a "claw" method to hold the cup. Similar to an airplane, these environments are generally unsanitary as individuals are handling money, handling other food items, and/or handling without having access to sanitizer or hand washing.

SUMMARY OF THE INVENTION

The drinking cup of the present invention is generally frusto-conical in shape with a generally circular closed bottom, a continuous sidewall extending from the bottom, and an open top opposite from the bottom. The diameter of the bottom is smaller than the diameter of the open top. This allows the cups to be stored in a nested fashion prior to use.

The open top is defined by the top edge of the sidewall. The sidewall extending from the bottom has two heights. Approximately 300 degrees of the sidewall, as viewed circularly, has a first height and the remaining 60 degrees has a second height which is shorter than the first height. The sidewall having the first height has a flap extending away from the interior cup and down from the top edge. In another embodiment the sidewall having the first height has a rolled rim in which the rim rolls away from the interior of the cup. The sidewall having the second height has a rolled rim rolling towards the interior of the cup. The sidewall having the first height is generally the gripping area and the sidewall with the second height is the drinking area.

The interior face of the bottom is concave in shape such that the bottom is thicker around the outside edge proximal to the sidewall. The increased thickness adds weight to the bottom proximal its circumference to add stability.

It is an aim of this invention to provide a sanitary cup that has both separate drinking surfaces and gripping surfaces.

It is a further aim to present such a sanitary cup that is both disposable and able to nest while being stored.

DETAILED DESCRIPTION

Figure 1:
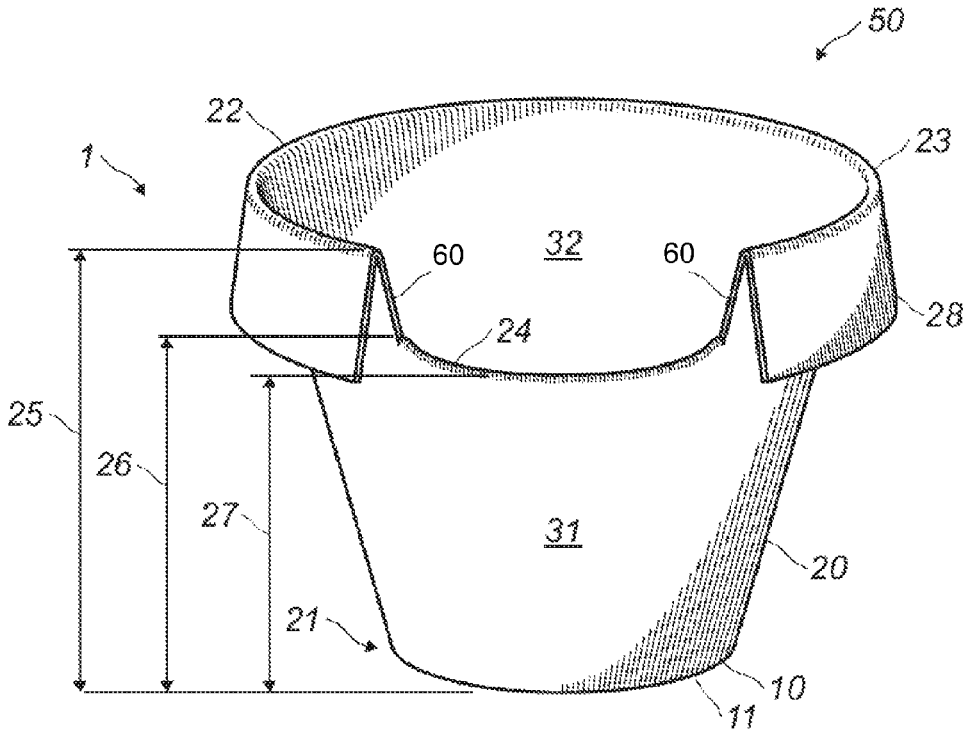
FIG. 1 is a perspective view of an embodiment of the present invention.
Figure 2:
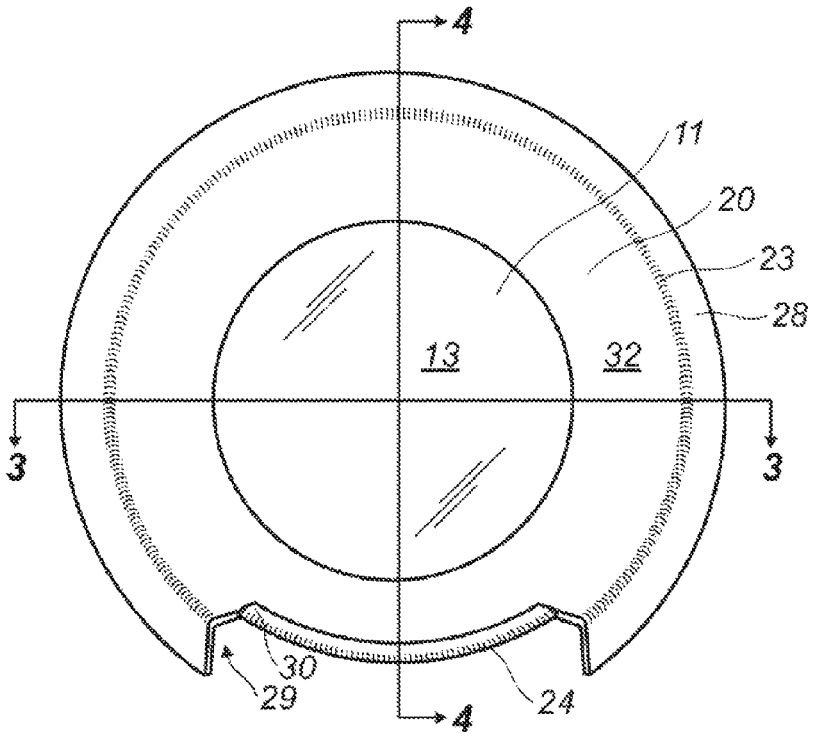
FIG. 2 is a top down view of the present invention.
Figure 3:
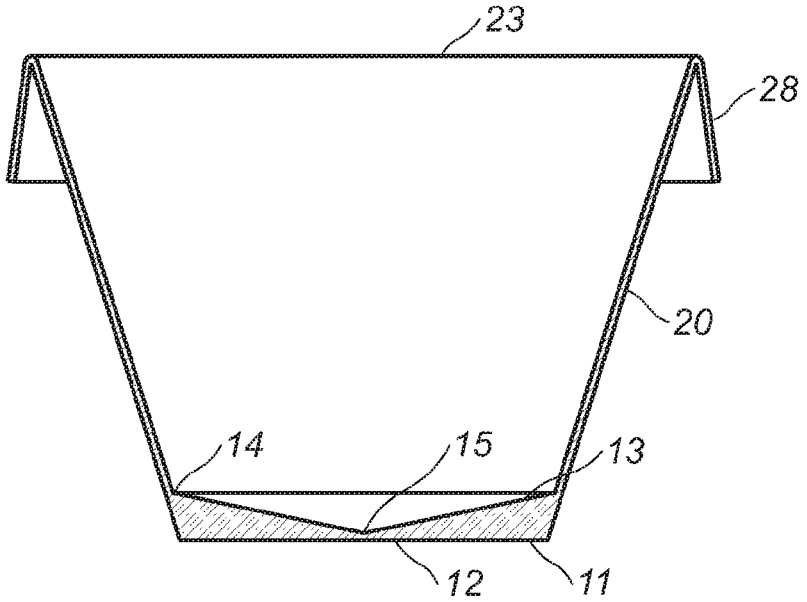
FIG. 3 is a cross section view along the line of 3-3 in FIG. 2.

As shown in FIGS. 1-4, the drinking cup 1 is a hollow frusto-conical structure comprising a bottom 10, a sidewall 20 and an open end 50. The bottom 10 further comprises a generally circular bottom wall 11 having a generally flat exterior surface 12 and a generally concave interior surface 13. The interior surface 13 of the bottom wall 11 tapers from its thickest portion 14 where the bottom wall 11 adjoins the sidewall 20 and to the thinnest portion 15 in the middle.

The sidewall 20 extends from the bottom wall 11 and is generally conical in shape as the diameter of the sidewall 20 is smallest at the bottom 10 and largest at the open end 50. Sidewall 20 has a bottom portion 21 that connects to the bottom wall 11 and a top edge 22 that forms the open end 50. The top edge 22 consists of a first edge 23, a second edge 24, and side edges 60 connecting the first edge 23 and second edge 24. The height 25 of the sidewall between the bottom wall 11 and the first edge 23 is uniform. The height 26 of the sidewall 20 between the bottom wall 11 and the second edge 24 is equal where the second edge 24 joins the side edge 25. The height 25 of the sidewall 20 between the bottom wall 11 and the first edge 23 is longer than the height 26 of the sidewall 20 between the bottom wall 11 and the second edge 24. The second edge 24 is curved as the height 27 measured between the bottom wall 11 and the midpoint of the second edge 24 is less than the height 26 from the edges of the second edge 24 and the bottom wall 11. In one embodiment, the first edge 23 accounts for approximately 300 to 270 degrees of the circumference of the open end 50 with the second edge 24 accounting for the remaining 60 to 90 degrees.

Figure 4:
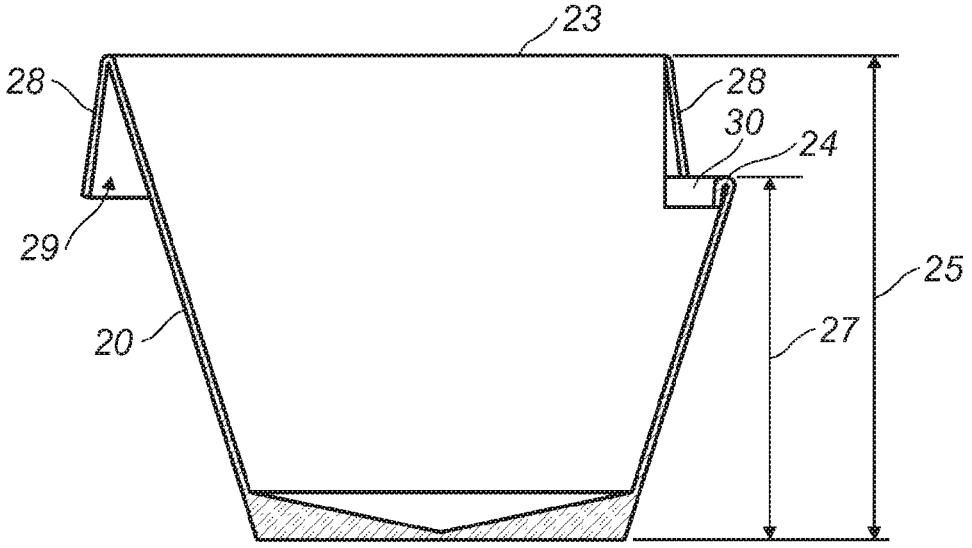
FIG. 4 is a cross section view along the line of 4-4 in FIG. 2.
Figure 5:
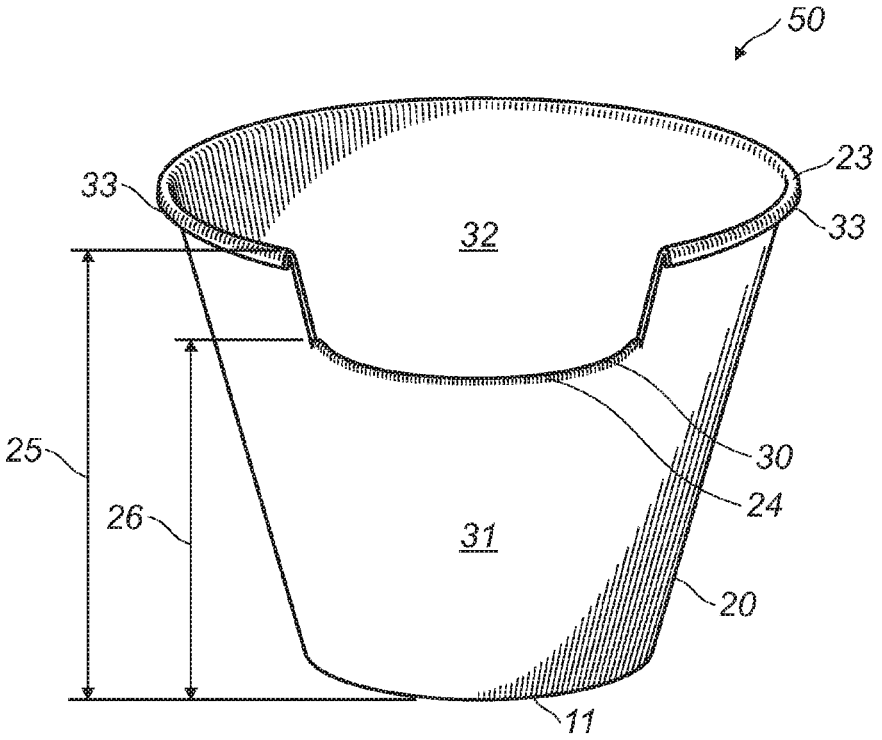
FIG. 5 is a perspective view of another embodiment of the present invention.

Extending from the first edge 23, away from the interior surface 32 of the drinking cup 1, is a flap 28. Flap 28 extends at a downward angle from the open end 50 creating a gap 29 between the flap 28 and the exterior face 31 of the sidewall 20. In one embodiment the flap 28 is approximately the length of the height difference between the first edge 23 and second edge 24. In another embodiment, as seen in FIG. 5, the length of the flap 33 is short or is alternatively rolled back towards the exterior surface 31 of the sidewall 20. As seen in FIG. 4, a rolled lip 30 extends from the second edge 24 towards the interior of the drinking cup 1 and abuts the interior surface 32 of the sidewall 20.

Figure 6:
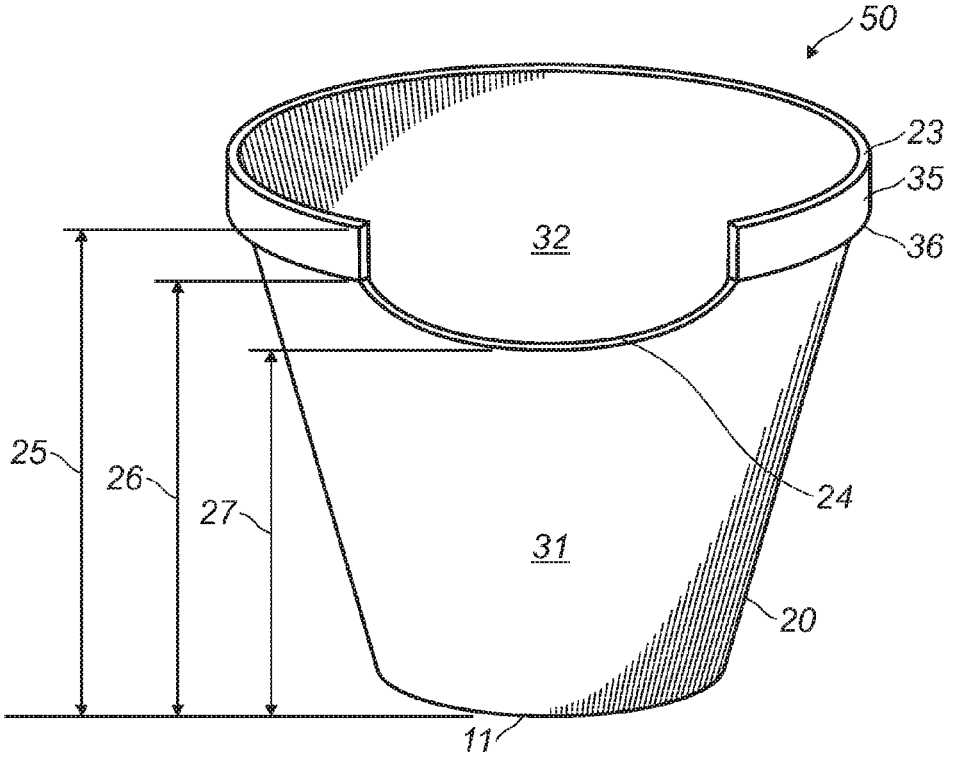
FIG. 6 is a perspective view of another embodiment of the present invention.

In another embodiment, as seen in FIG. 6, a lip 35 extends from first edge 23 having a length that is approximately equal to the height difference between the first edge 23 and second edge 24. The lip 35 is thicker than the thickness of the sidewall 20 resulting in a shoulder 36.

The drinking cup 1 may be constructed of a conventional plastic such as polyethylene terephthalate (PET), paper, or polystyrene foam. The frusto-conical shape of the sidewall 20 and bottom 10 permit the drinking cups 1 to be nested to provide for ease of shipping and saving of space.

The first edge 23 forms a gripping service whereas the second edge 24 forms a drinking surface. The height differential between first edge 23 and second edge 24 encourages a user to grasp the drinking cup by the first edge 23 and to avoid touching the second edge 24. Furthermore, the flap 28, 33 and shoulder 36 provide a differentiated surface from the smooth sidewall 20 that create an ideal surface to grip whereas the smooth outside portion of the second edge 24 discourages gripping. The flap 28, 33 and shoulder 36 have a practical effect of digging into the user's fingers to aid in gripping. The second edge 24 encourages the ultimate end user to drink from the second edge 24 as it is shaped to accommodate the end user's lips.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims.

I claim:

1. A cup comprising a bottom wall;

a sidewall having a first end connected to the bottom wall and a second open end having a first edge and second edge wherein the sidewall and bottom wall define a cavity;

a first lip extending from the second edge towards the bottom wall along the interior face of the sidewall and abutting the interior face of the sidewall;

a second lip extending from the first edge along the exterior face of the sidewall;

the height of the sidewall between the bottom wall and the first edge is greater than the height of the sidewall between the bottom wall and the second edge; and the length of the first edge is at least twice the length of the second edge.

2. The cup of claim 1 wherein the bottom wall and the sidewall form a frusto-conical structure.

3. The cup of claim 1 wherein said second lip is a flap.

4. The cup of claim 3 wherein the length of the flap is approximately equal to the difference in length between the height of the sidewall between the bottom wall and the first edge and the height of the sidewall between said bottom wall and the second edge.

5. The cup of claim 2 wherein the interior surface of the bottom wall is concave with the bottom wall thicker proximal to the sidewall.

6. The cup of claim 2 wherein the exterior surface of the bottom wall is flat.

7. The cup of claim 2 wherein the angle corresponding to the length of first edge is between 270 degrees and 330 degrees.

8. The cup of claim 2 wherein the angle corresponding to the length of first edge is 300 degrees.

9. The cup of claim 1 wherein the second edge is curved towards the bottom wall with the deepest portion of the curve at the midpoint of the second edge.

* * * * *